United States Patent [19]

Betz

[11] Patent Number: 4,627,407

[45] Date of Patent: Dec. 9, 1986

[54] IGNITION COIL FOR MULTI-CYLINDER INTERNAL COMBUSTION ENGINE

[75] Inventor: Dieter Betz, Vaihingen, Fed. Rep. of Germany

[73] Assignee: Robert Bosch GmbH, Stuttgart, Fed. Rep. of Germany

[21] Appl. No.: 684,092

[22] Filed: Dec. 20, 1984

[30] Foreign Application Priority Data

Mar. 30, 1984 [DE] Fed. Rep. of Germany ..... 3411844

[51] Int. Cl.[4] ..... F02P 3/02

[52] U.S. Cl. ..... 123/634; 123/621; 123/643; 336/110

[58] Field of Search ..... 123/621, 622, 634, 643; 336/110; 315/209 M, 212

[56] References Cited

U.S. PATENT DOCUMENTS 3,209,295 9/1965 Baermann ..... 123/634

4,233,949 11/1980 Poirier d'Ange d'Orsay ..... 123/634

FOREIGN PATENT DOCUMENTS 53-21335 2/1978 Japan ..... 123/621

*Primary Examiner*—Andrew M. Dolinar

*Attorney, Agent, or Firm*—Frishauf, Holtz, Goodman & Woodward

[57] ABSTRACT

To reliably provide ignition energy only to specific spark plugs (11, 12; 14, 15) of a multi-cylinder internal combustion engine (ICE), a double-E core has primary windings (6, 8) located on a main or central branch, and separate secondary windings (10, 13) located in shunt branches, each secondary winding being associated with respective spark plugs. The primary windings are so energized that, at any one time, only one of the primary windings is conductive. In accordance with the invention, permanent-magnet biasing magnets (18, 20) are located in air gaps in the shunt magnetic paths (17, 19), and so polarized that the flux generated upon current flow through the respective branches of the primary windings is counter the bias magnetization of the respective magnet (18, 20) in the respective shunt path (17, 19) on which the secondary winding (10, 13) is wound which is associated with the respectively energized primary winding (e.g. primary 6-secondary 10; upon energization of primary winding 6, the flux will oppose the flux on magnet 18).

6 Claims, 2 Drawing Figures

IGNITION COIL FOR MULTI-CYLINDER INTERNAL COMBUSTION ENGINE

Reference to related patent:

U.S. Pat. No. 4,233,949, Nov. 18, 1980, POIRIER D'ANGE D'ORSAY.

Reference to related application:

U.S. Ser. No. 686,210, filed Dec. 26, 1984, BETZ, now U.S. Pat. No. 4,599,985, issued July 15, 1986 to the assignee of the present application.

The present invention relates to an ignition coil for a multi-cylinder internal combustion engine, and more particularly to an ignition coil which has a plurality of output windings for a plurality of spark plugs, and a plurality of primary windings which are separately controlled by separate control switches, so that selected spark plugs can be energized by selected primary windings and a distributor for distributing spark energy is not needed.

BACKGROUND

It has previously been proposed to make ignition coils for multi-cylinder internal combustion engines in such a way that a primary leg of the coil has a pair of primary windings secured thereto. The primary leg is coupled, magnetically, to two parallel shunt magnetic portions, each one having a secondary winding wound thereon. An air gap is placed in the shunt magnetic portions. The primary windings are selectively controlled by breaker switches—which may be transistors—in such a manner that the ignition instant for spark flash-over from the secondary windings occurs at different times. A common current source is provided for the primary windings and the respective interrupter or breaker switches. The windings are magnetically so coupled with each other that, upon interruption of current in one of the primary windings, the voltage induced in only one of the secondary windings is sufficient for flash-over of a spark at the respective associated spark plug. Such a coil is described, for example, in the referenced U.S. Pat. No. 4,233,949.

The air gaps in the secondary or shunt branches require a substantial amount of electrical energy to be transferred into magnetic energy in order to generate effective sparks at the spark plug.

THE INVENTION

It is an object to improve an ignition coil for a distributorless multi-cylinder internal combustion engine which is compact and increases the efficiency of electrical-to-magnetic and again magnetic-to-electrical energy.

Briefly, the core is, for example, of the double-E type, having a main center winding branch and two parallel secondary branches, forming a closed magnetic circuit in which, however, an air gap is provided in each respective magnetic circuit which include the secondary branches. In accordance with the present invention, a permanent magnet is located in each air gap and so poled that the primary windings, when respectively energized, cause magnetic flux which is counter the flux generated by the respective permanent magnet. The primary windings, themselves, are so wound that the directions of flux generated by the respective primary windings are opposite each other. It is customary to operate such coils in a condition in which, when one breaker switch, serially connected with a primary winding, is closed, the other, controlling current flow to the other primary winding, will be open, so that magnetic flux through the main leg or branch of the core will be generated by only one of the primary windings at any time.

The coil has the advantage that the electrical energy is converted to magnetic energy for reconversion into electrical spark energy with higher efficiency than heretofore possible, to generate more effective sparks; and, further, in providing a structure which is compact and readily accomodated within the usual limited space of the engine compartment of an automotive vehicle, in which the internal combustion engine (ICE) with which the spark plug is to be used is, typically, located.

DRAWINGS

FIG. 1 is a part-electrical schematic, part-magnetic schematic diagram of the ignition coil in accordance with the present invention, in which the electrical schematic diagram illustrates the connections of windings to the coil; and FIG. 2 is a top view of the coil of FIG. 1.

DETAILED DESCRIPTION

Figure 1:
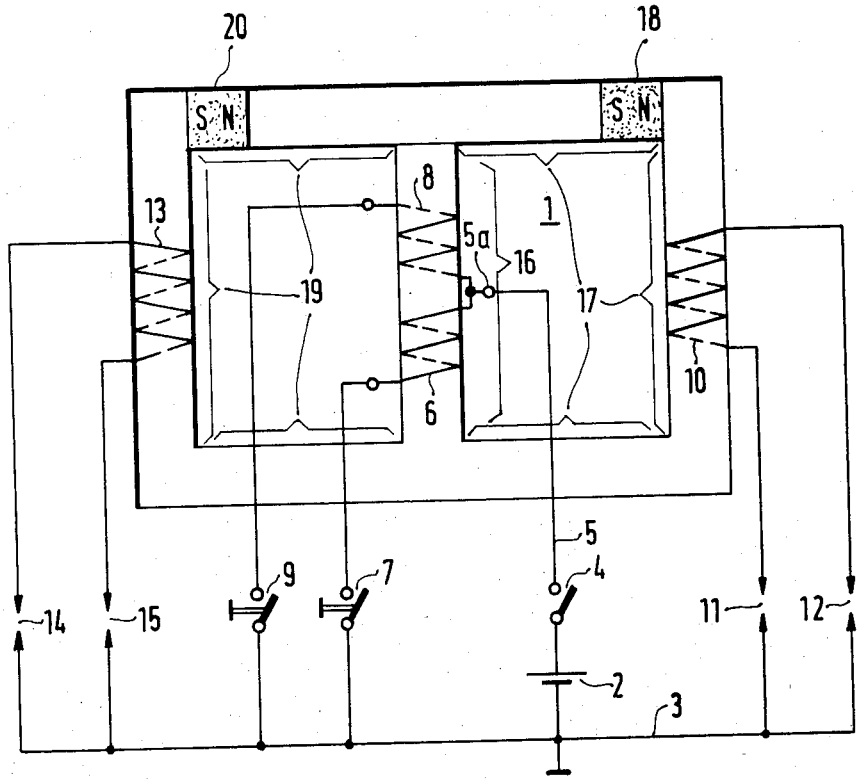

The ignition coil of FIG. 1 is to be used with the ignition system of an ICE, for example installed in automotive vehicle. A current source 2, for example the battery of the vehicle, supplies ignition energy. The current source 2 is connected to a ground or chassis bus 3 and to a positive or operating bus 5 through an ignition or main switch 4.

The positive or operating bus 5 has a junction 5*a* to which two primary branch windings 6, 8 are connected. Primary winding 6 is serially connected through a breaker switch 7, shown schematically in FIG. 1 but which, for example, may be a transistor or other controlled switch operating, for example, under control of an electronically controlled ignition system. Primary winding 8, also connected to junction 5*a*, is connected through a breaker switch 9 which may be identical to switch 7. The terminals of the primary windings 6, 8 remote from the switches 7, 9 are connected to the ground or chassis bus 3.

The two breaker switches 7, 9 are operated to control ignition timing instants which are different. The switching timing of the switches 7, 9 is such that one of the switches 7, 9 can open only when the other is already in open condition. Usually, only one of the switches 7, 9 can be closed at any one time and subsequently opened rapidly, to induce an ignition pulse in the secondary windings. The previously open switch may then close, although this is not necessary; the cycle may repeat with the same switch, for subsequent sequential repetition by the other. The ignition coil, generally shown at 1, has two secondary windings 10, 13. Secondary winding 10 is connected through two ignition spark plugs 11, 12 to the ground or chassis bus 3. Secondary winding 13 is connected to two associated spark plugs 14, 15 to the ground or chassis bus 3. The arrangement is shown for a four-cylinder ICE; in a two-cylinder ICE, each one of the secondary windings 10, 13 would, for example, be connected to only one spark plug group, e.g. spark plugs 12, 14, respectively, and the other terminal of the respective secondary windings would be directly connected to the ground or chassis bus 3.

The two primary windings 6, 8 are located on a main or reference leg 16 of the core such that, when current flows through the windings 6, 8, the magnetic flux fields generated by the respective windings will be oppositely directed. In addition to the main or reference leg 16, two parallel shunt leg portions 17, 19 are provided. Shunt leg portion 17 has the secondary winding 10 located thereon. An air gap is left within the secondary shunt path 16. Secondary shunt path 19 likewise has an air gap located therein.

In accordance with the present invention, the air gaps in the secondary or shunt magnetic paths are filled with permanent magnet materials, that is, include permanent magnets 18, 20, poled or polarized as shown in FIG. 1. The polarization of magnet 18 is such that the magnetic flux of magnet 18 is counter the magnetic flux which is generated by the primary winding 6 when current flows through the primary winding 6. The permanent magnet 20 is so polarized that the magnetic flux of the magnet 20 is opposite the magnetic flux when the primary winding 8 has current flowing therethrough upon closing of switch 9.

In a preferred form of the invention, the permanent magnets 18, 20 are cobalt-samarium magnets. The secondary or shunt magnetic circuits 17, 19, including the permanent magnets 18, 20, preferably are symmetrical and of identical construction.

OPERATION

The ignition system is ready when the main switch 4 is closed. Let it be assumed, first, that by external control, for example due to the ignition system, and its coupling to the rotation of the ICE, the breaker switch 9 is closed, that is, passes current. By the definition of the system, breaker switch 7 will be open. When breaker switch 9 is closed, current will flow through primary winding 8. Magnetic flux generated by primary winding 8 is counter the magnetic flux due to the permanent magnet 20. Thus, in view of the hysteresis in the magnetic circuit biased by the magnet 20, a substantial change in magnetic induction will result. The magnetic flux due to the permanent magnet 18, which is in the same direction as that of the primary winding 8, will not change essentially, however, so that in the shunt path 18 only a small change in magnetic flux will occur.

Upon break or opening of the breaker switch 9, the voltage induced in the secondary winding 13, coupled to the magnetic path 19, will be due to a substantial change in magnetic flux so that the voltage induced in the winding 13 will be high and substantial and sufficient for providing a spark discharge or ignition spark at the spark plugs 14, 15. The voltage induced in the secondary winding 10, however, will be much too low for breakdown of the spark gaps of the spark plugs 11, 12.

Upon subsequent closing of breaker switch 10, a substantial change in flux, due to reversal of flux direction, will result when the primary winding 6 carries current. Breaker switch 9 remains open. Upon opening of the breaker switch 7, then, secondary winding 10 will have a high voltage pulse induced therein causing spark breakdown at the spark plugs 11, 12. The voltage induced in secondary winding 13, however, will be insufficient for generating a spark at the plugs 14, 15.

If necessary, diodes may be connected in series with the spark plugs 11, 12 and 14, 15, respectively, which are so poled that the low voltage which occurs when the breaker switch not associated with the respective spark plugs is blocked, but which are capable of passing the electrical voltage when the respective spark plugs should fire. Such diodes are not absolutely necessary and are no shown; they may be used to increase the reliability against spurious sparks.

Figure 2:
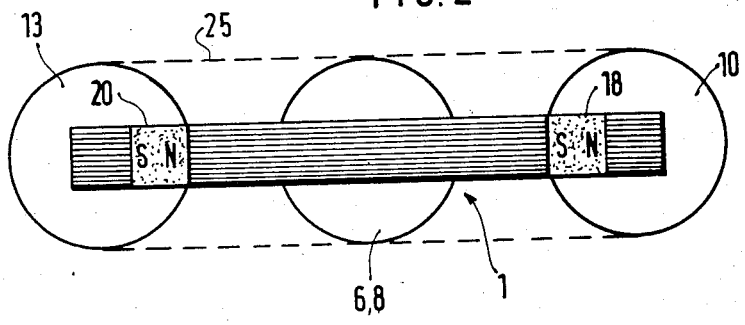

The windings 6, 8, 10, 13 can be individually potted in a potting compound or, preferably, and as shown by broken line 25, FIG. 2, can be commonly potted with a suitable casting compound, such as a casting resin. Each one of the secondary windings 10, 13 may, of course, only be connected to a single spark plug.

I claim:

1. Ignition coil, for a distributorless ignition system of an internal combustion engine, having first (6) and second (8) primary windings;

first (10) and second (13) secondary windings, one each being associated with a primary winding;

means (7, 9) for selectively energizing one of said primary windings;

a unitary E-shaped core having a central branch defining a main core portion (16), on which the primary windings are wound, and two outer core branches defining secondary core portions magnetically coupled to the main core portion and located magnetically in shunt with respect to each other, and forming, with the main core portion (16), two parallel secondary magnetic circuits (17, 19), each secondary core portion having a secondary winding (10,13) wound thereon, wherein, in accordance with the invention, a further crossbar core portion is provided, having two end each separated by a gap from one of said outer core branches, said crossbar core portion being disposed contiguous to said main core portion, each secondary magnetic circuit (17, 19) is a ferromagnetically continuous circuit and includes, in said gap between said crossbar core portion and said outer core branch a permanent magnet (18, 20) filling said gap, completing said magnetic circuit and polarized to apply a magnetic bias, to the respective magnetic circuit (17, 19), which bias is opposite to the magnetic field induced in the secondary magnetic circuit (17, 19) upon energization of the selected primary winding (6,8) controlling generation of an ignition spark impulse from the secondary winding (10,13) associated with said selected primary winding (6,8) and wound on the respective secondary core portion, which portion forms part of the respective secondary magnetic circuit (17,19).

2. Ignition coil according to claim 1, wherein the primary windings (6, 8) comprise a center-tapped winding.

3. Ignition system for an internal combustion engine comprising the ignition coil claimed in claim 1 and including selectively operable switching means (7, 9) connected to apply electrical energization to a respective one of the two primary windings (6, 8), and operable to connect only one of said primary windings, at any one time, to said source of energization.

4. Ignition system according to claim 3, wherein the primary windings (6, 8) comprise a center-tapped winding.

5. Ignition coil as claimed in claim 1, wherein each of the secondary magnetic circuits (17, 19) includes an air gap;

and wherein said permanent magnets (18, 20) are located in the respective air gaps.

6. Ignition system according to claim 3, wherein each of the secondary magnetic circuits (17, 19) includes an air gap;

and wherein said permanent magnets (18, 20) are located in the respective air gaps.

* * * * *